US011800271B2

(12) United States Patent
Golden

(10) Patent No.: US 11,800,271 B2
(45) Date of Patent: Oct. 24, 2023

(54) MICROPHONE BED

(71) Applicant: Derrick P. Golden, Warsaw, IN (US)

(72) Inventor: Derrick P. Golden, Warsaw, IN (US)

( * ) Notice: Subject to any disclaimer, the term of this patent is extended or adjusted under 35 U.S.C. 154(b) by 2 days.

(21) Appl. No.: 17/718,700

(22) Filed: Apr. 12, 2022

(65) Prior Publication Data

US 2022/0329925 A1 Oct. 13, 2022

Related U.S. Application Data

(60) Provisional application No. 63/173,663, filed on Apr. 12, 2021.

(51) Int. Cl.
*H04R 1/08* (2006.01)

(52) U.S. Cl.
CPC ..... *H04R 1/08* (2013.01); *H04R 2201/02* (2013.01)

(58) Field of Classification Search
CPC . H04R 1/00; H04R 1/02; H04R 1/025; H04R 1/028; H04R 1/04; H04R 1/08; H04R 1/083; H04R 2201/02
See application file for complete search history.

(56) References Cited

U.S. PATENT DOCUMENTS 7,979,035 B2 * 7/2011 Griffin ..... H04M 1/6091 455/90.3
10,424,955 B2 * 9/2019 Higgins ..... H04R 25/55
11,170,749 B2 * 11/2021 Smith ..... G10K 11/025

FOREIGN PATENT DOCUMENTS

CN 211944352 U * 11/2020
CN 212624776 U * 2/2021
CN 212936134 U * 4/2021
CN 216510084 U * 5/2022

* cited by examiner

*Primary Examiner* — Thang V Tran
(74) *Attorney, Agent, or Firm* — Taylor IP, P.C.

(57) ABSTRACT

A microphone bed for receiving a microphone. The microphone bed including a first compressible portion and first and second non-compressible portions. The first compressible portion is formed to accommodate a first end of the microphone. The first non-compressible portion has the compressible portion coupled thereto, the non-compressible portion having a length that is over half a length of the microphone. The second non-compressible portion is coupled to the first non-compressible portion, which together form a cavity therebetween, the second non-compressible portion having a floor. There is a weighted feature extending upward from the floor of the second non-compressible portion.

20 Claims, 7 Drawing Sheets

MICROPHONE BED

CROSS REFERENCE TO RELATED APPLICATIONS

This is a non-provisional application based upon U.S. provisional patent application Ser. No. 63/173,663, entitled "MICROPHONE BED", filed Apr. 12, 2021, which is incorporated herein by reference.

BACKGROUND OF THE INVENTION

1. Field of the Invention

The present invention relates to a microphone holding platform, and, more particularly, to a microphone bed with sculpted preformed holding portions.

2. Description of the Related Art

A microphone, which is often referred to as a mic or mike, is a transducer that converts sound into an electrical signal. While microphones are used in many applications such as telephones, hearing aids, public address systems for concert halls and public events, motion picture production, live and recorded audio engineering, sound recording, two-way radios, megaphones, and radio and television broadcasting, in this application it is used to refer to those used in live productions and recording studios.

Microphones are often stored in cushioned cases to protect them from damage. Such cases typically have cavities for separating the mics and are usually made with open cell foam. While such cases are good for transport they are less than ideal for use when mics are being handled, since they can restrict access to the mics and do not typically present the mics in an easy to access presentation.

What is needed in the art is a microphone bed that presents the microphones for immediate use and affords protection for the microphones.

SUMMARY OF THE INVENTION

The present invention provides a formed bed for receiving a microphone.

The invention in one form is directed to a microphone bed for receiving a microphone. The microphone bed including a first compressible portion and first and second non-compressible portions. The first compressible portion is formed to accommodate a first end of the microphone. The first non-compressible portion has the compressible portion coupled thereto, the non-compressible portion having a length that is over half a length of the microphone. The second non-compressible portion is coupled to the first non-compressible portion, which together form a cavity therebetween, the second non-compressible portion having a floor. There is a weighted feature extending upward from the floor of the second non-compressible portion.

The invention in another form is directed to a microphone bed for receiving a microphone. The microphone bed including a first compressible portion and first and second non-compressible portions. The first compressible portion is formed to accommodate a first end of the microphone. The first non-compressible portion has the compressible portion coupled thereto, the non-compressible portion having a length that is over half a length of the microphone. The second non-compressible portion is coupled to the first non-compressible portion, which together form a cavity therebetween, the second non-compressible portion having a floor. There is a weight receiving feature extending upward from the floor of the second non-compressible portion.

The invention in yet another form is directed to a microphone bed tray that contains a plurality of microphone beds for receiving a microphone. The microphone beds including a first compressible portion and first and second non-compressible portions. The first compressible portion is formed to accommodate a first end of the microphone. The first non-compressible portion has the compressible portion coupled thereto, the non-compressible portion having a length that is over half a length of the microphone. The second non-compressible portion is coupled to the first non-compressible portion, which together form a cavity therebetween, the second non-compressible portion having a floor. There is a weighted feature extending upward from the floor of the second non-compressible portion.

An advantage of the present invention is that the microphones are easily accessible.

Another advantage is that spare batteries are beneath the microphones.

Yet another advantage is that the formed portion holding the top end of the microphone is easily removed and replaced with a formed portion for a different type of microphone.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
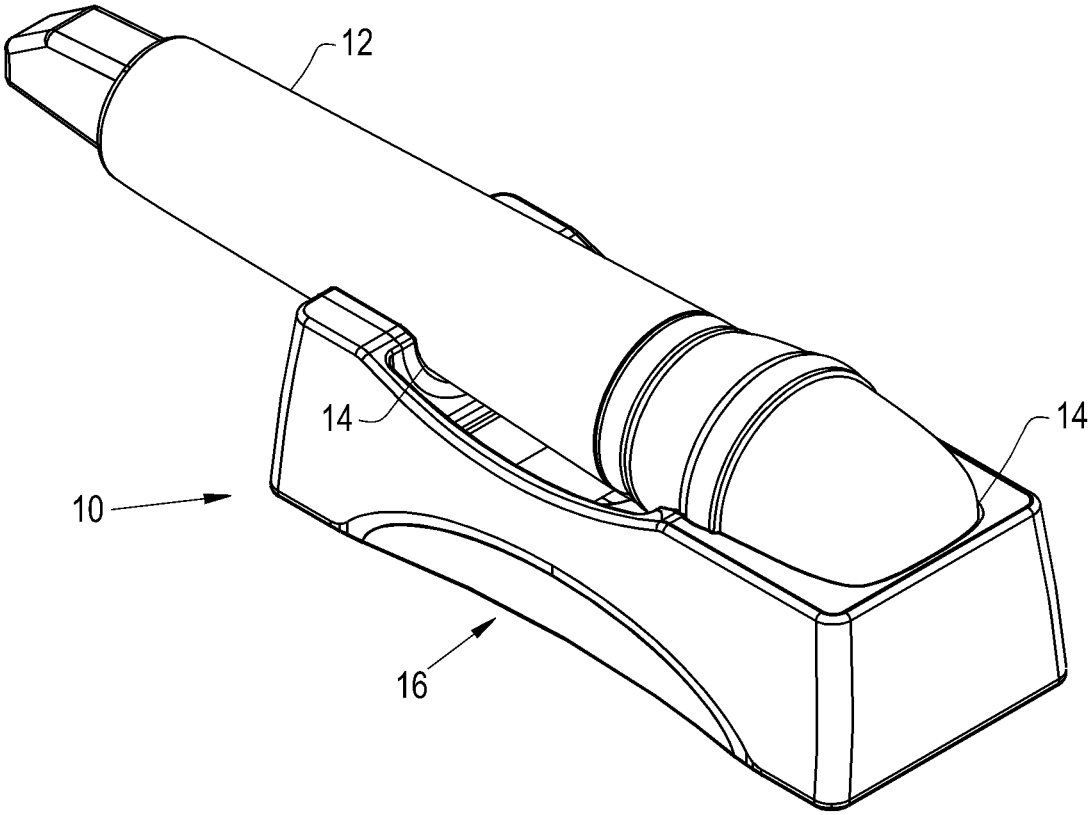
FIG. 1 is a perspective view of an embodiment of a microphone bed of the present invention holding a microphone.

Referring now to the drawings, and more particularly to FIG. 1, there is shown a microphone bed 10 formed to securely hold microphone 12 on a flat surface like a table, lectern, or stage. It is an alternative to the common microphone on a stand using a microphone clip.

Microphone bed 10 cradles a microphone 12 by having internal contours 14 that are provided to conform with the outer profile of microphone 12. Microphone bed 10 additionally has outer contours 16 that contribute to the ergonomics of microphone bed 10.

Figure 2:
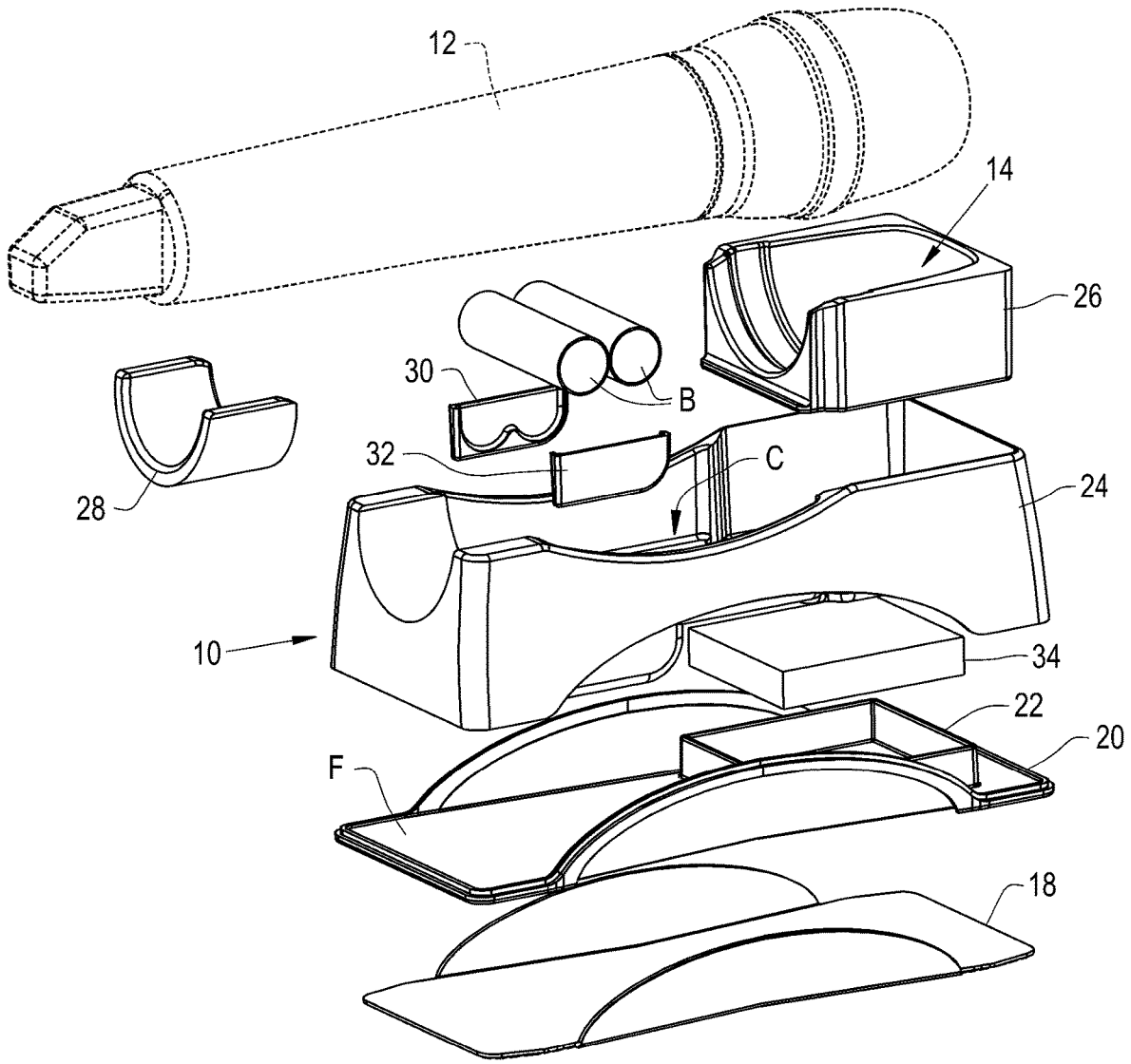
FIG. 2 is an exploded perspective view of the microphone bed of FIG. 1.

FIG. 2 is a perspective exploded view of microphone bed 10 illustrating that a lower portion of microphone 12 extends off the end of microphone bed 10 and is above the flat surface upon which microphone bed 10 rests, in order to accommodate easy access to microphone 12 by a user.

Microphone bed 10 includes a compressible portion 18, with a rigid non-compressible portion 20 coupled thereto. Non-compressible portion 20 has a weight receiving feature 22 extending from a floor F of non-compressible portion 20. Non-compressible portion 20 is coupled to a non-compressible portion 24, which together form a cavity therebetween. A compressible portion 26 is formed to accommodate a first end of microphone 12. Portion 26 is removably retained in portion 24, and can be changed out to accommodate another type of microphone 12.

A compressible portion 28 is coupled to non-compressible portion 24, with portion 28 being positioned to accommodate a mid-portion of microphone 12. Non-compressible portion 24 has a length that is over half of the length of microphone 12. Compressible portion 28 is at an end of non-compressible portion 24 opposite where compressible portion 26 is positioned.

Non-compressible portion 24 has a battery cavity C beneath where microphone 12 lays in microphone bed 10. Compressible pads 30 and 32 are connected to opposite ends of battery cavity C, with compressible pads 30 and 32 being configured to secure batteries B in battery cavity C. Alternatively, compressible pads 30 and 32 can be connected together and may extend along the inner portion of battery cavity C. This alternative can serve to prevent batteries B from moving in cavity C if microphone bed 10 is moved or jostled.

A weight 34, which may contain a functional control, discussed below, is connected within retaining feature 22 to give microphone bed 10 some stability to carry out its use as a bed for microphone 12.

Figure 3:
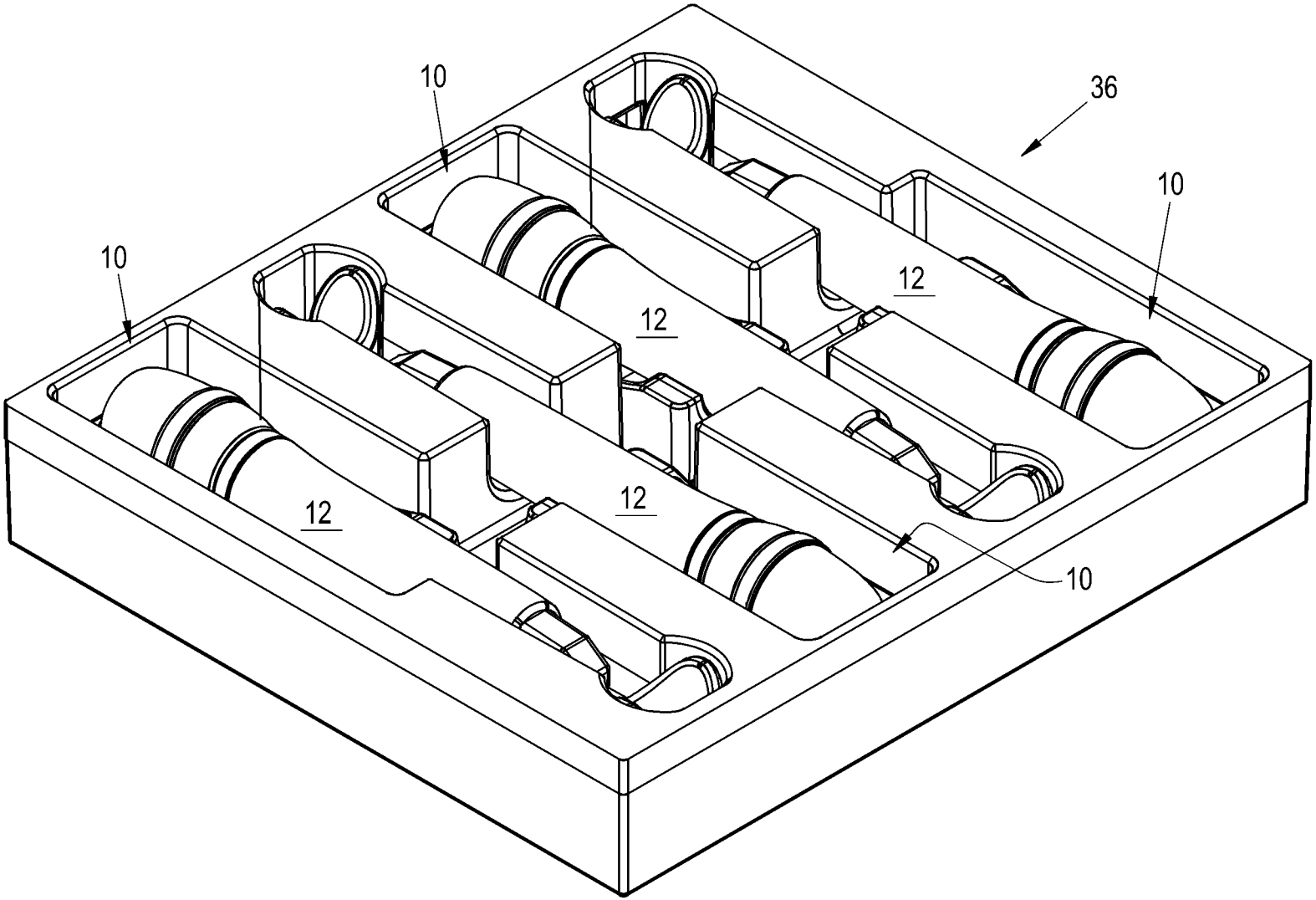
FIG. 3 is a perspective view of and embodiment of a tray of the present invention with multiple microphone beds of FIGS. 1 and 2 installed therein.

Now, additionally referring to FIG. 3, there is a perspective view of a microphone bed tray 36, which holds four microphone beds 10. Microphone beds 10 are configured to be inserted into one of a plurality of bed receiving cavities in microphone bed tray 36.

Figure 4:
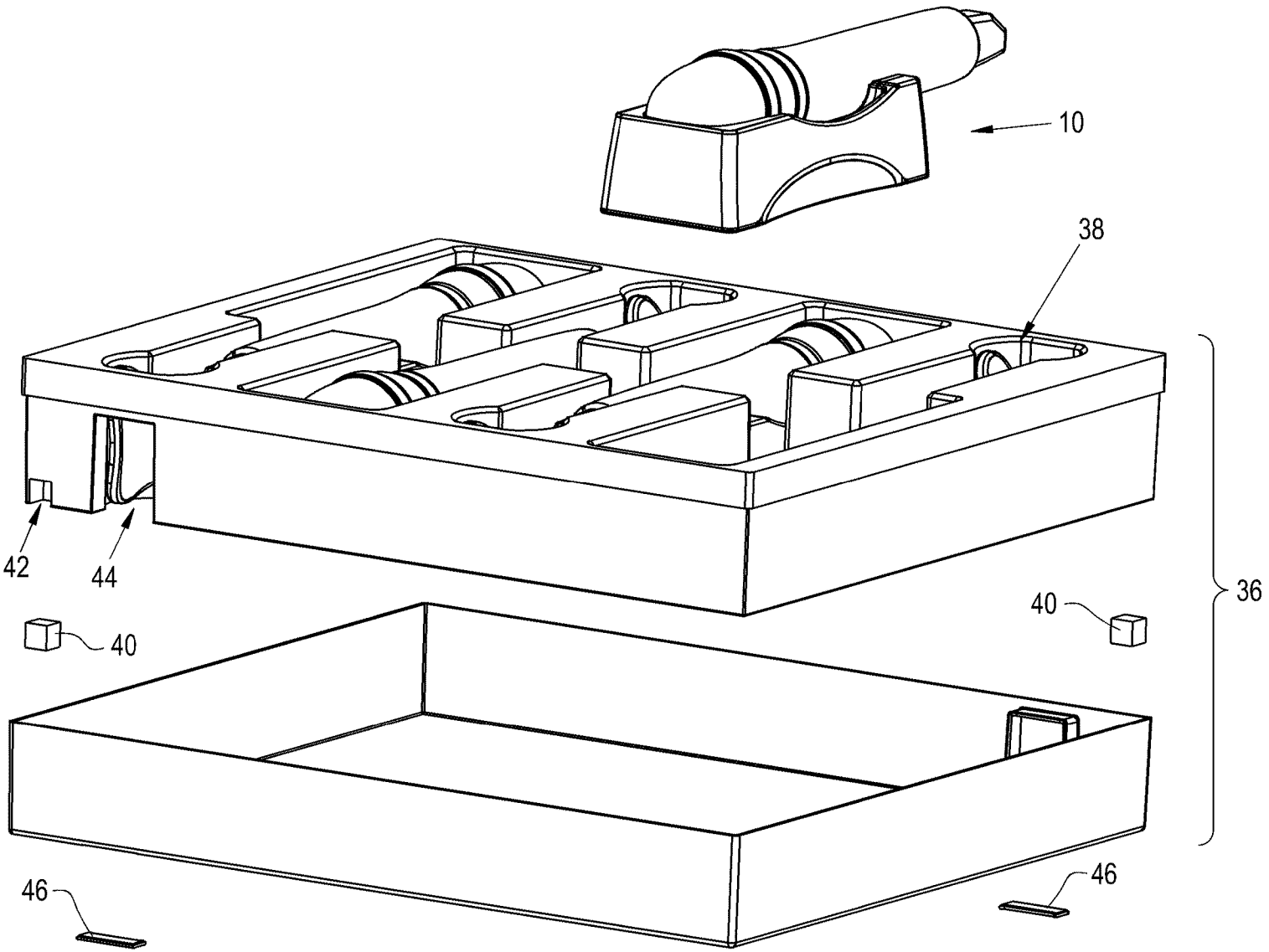
FIG. 4 is an exploded perspective view of the tray of FIG. 3 with one of the microphone beds FIGS. 1 and 2, being exploded upward to illustrate the relationship of the microphone beds of FIGS. 1 and 2 relative to the tray.

Now, additionally referring to FIG. 4, there is illustrated an exploded view of one microphone bed 10 above tray 36, which may be held in place by way of an interfering fit or edge features that are accommodated by complementary edge features around receiving cavity 38.

Microphone beds 10 are available in a range of microphone profiles to accommodate different microphone designs, by selecting a portion 14 that accommodates a specific microphone 12. The most common microphones being the Sennheiser SKM100 and Shure ULX handheld wireless transmitters. Custom foam inserts 14 allow for the storage of microphones 12 along with their microphone bed 10 in a standard case 36 or in a 19' rack drawer.

Tray 36 has magnets 40 inserted into and connected to cavities 42 to secure tray 36. Handle inserts 44 allow a user to lift the top portion from a bottom portion. Nonskid strips 46 are coupled to reduce slipping of tray 36.

Figure 5:
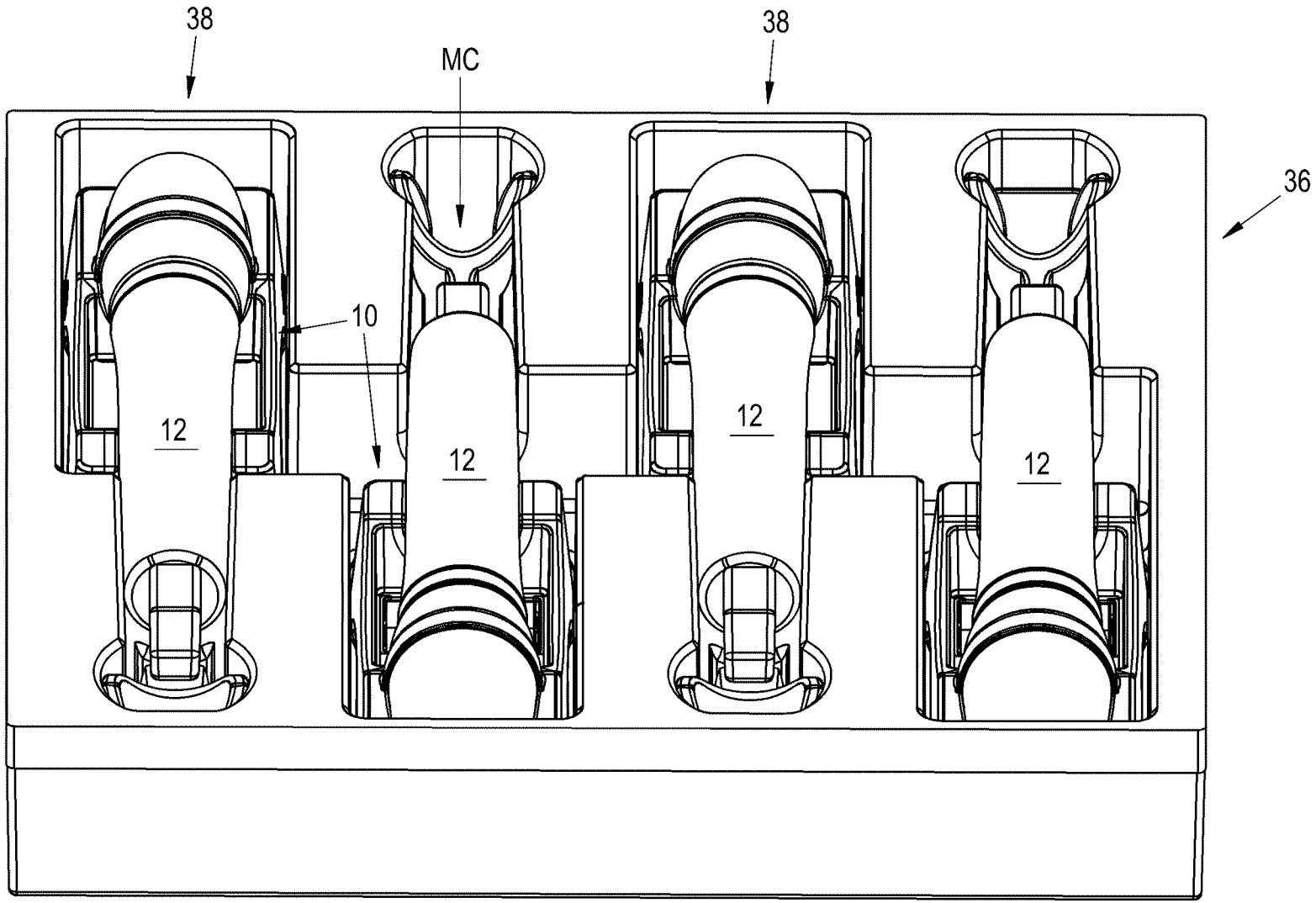
FIG. 5 is another perspective view of the tray of FIGS. 3 and 4 with four microphone beds of FIGS. 1 and 2 installed therein and microphones placed therein.
Figure 6:
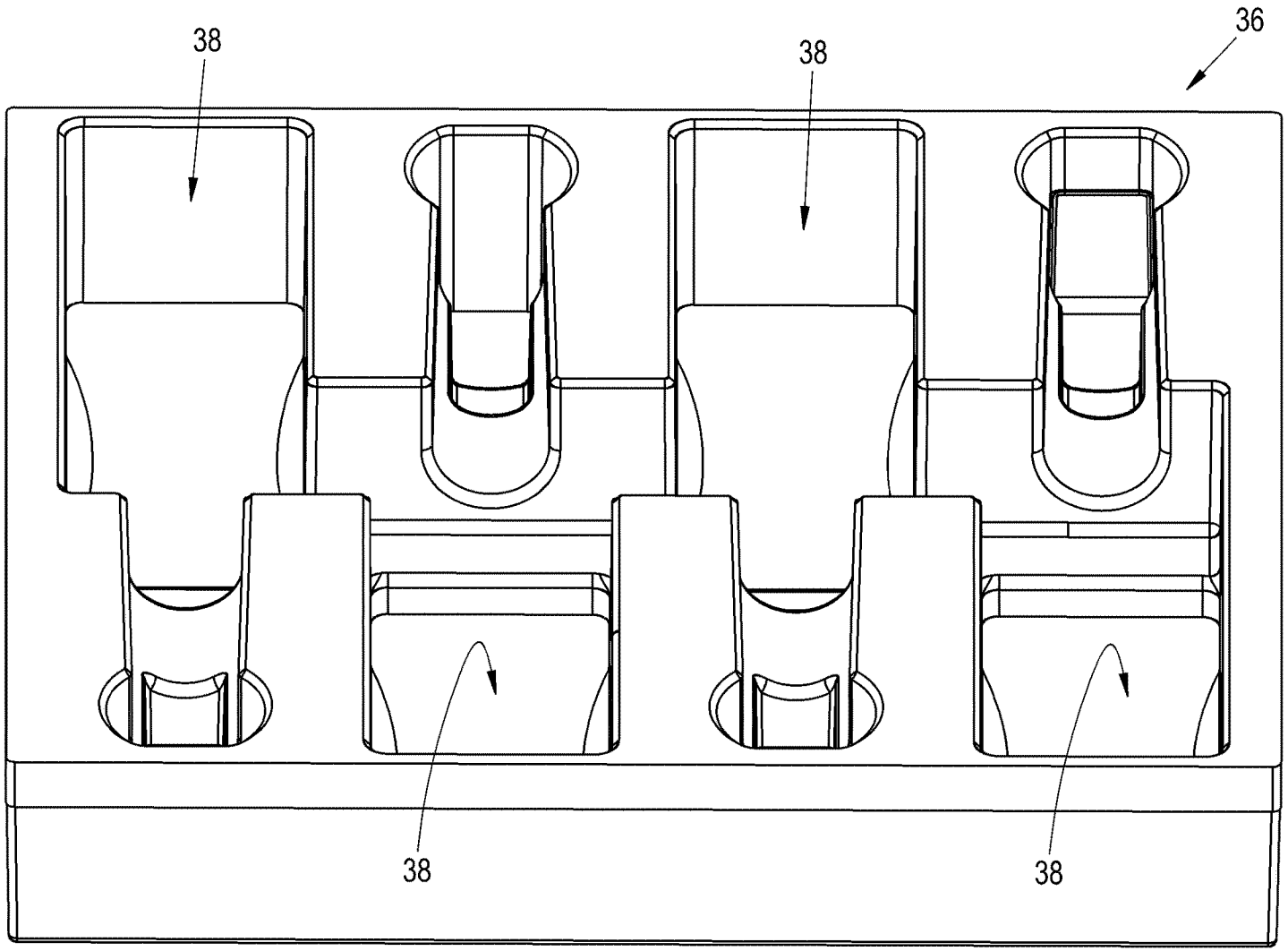
FIG. 6 is another view of the tray of FIG. 5 with the microphones removed.

Now additionally referring to FIGS. 5 and 6, tray 36 is show full in FIG. 5 and empty in FIG. 6. In FIG. 5 microphone beds 10 fill cavities 38 and microphone clips MC are shown to illustrate that clips MC can be stored in tray 36 along with their associated microphones 12. FIG. 6 illustrates what tray 36 looks like when empty.

Figure 7:
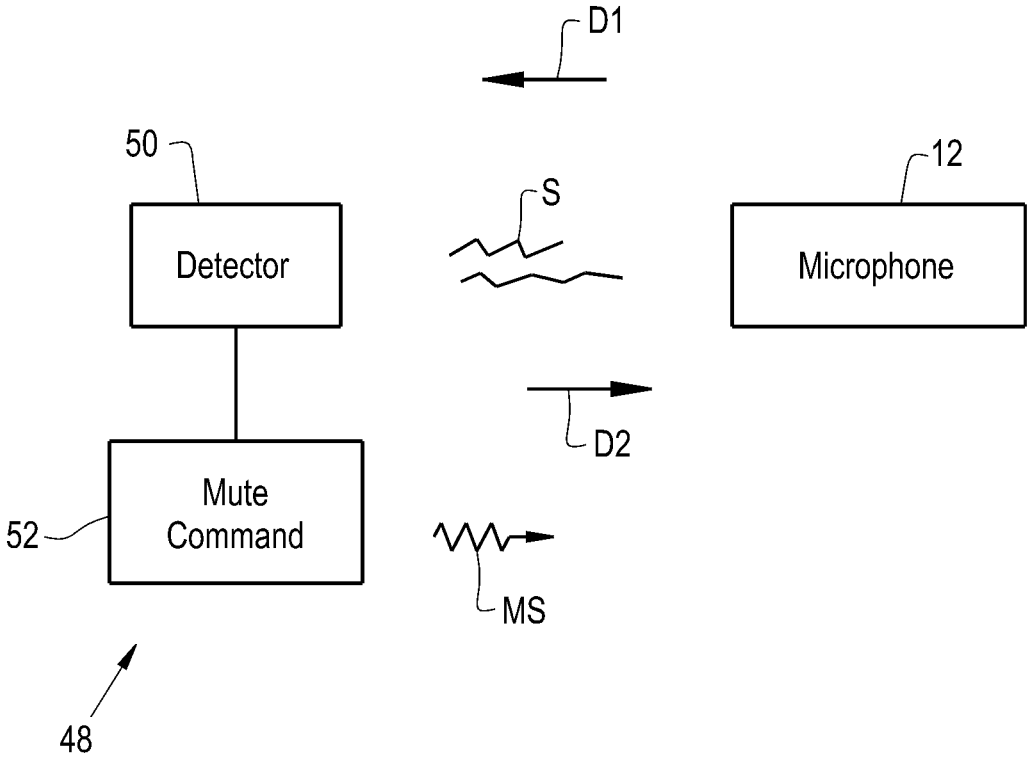
FIG. 7 schematically illustrates the functioning of an auto-mute function of the present invention that is in the microphone bed of FIGS. 1 and 2.

Now, additionally referring to FIG. 7, there is illustrated in a schematic form an auto-muting function 48 that can be placed in cavity 22 instead of, or in addition to, weight 34. As microphone 12 moves in direction D1 (toward detector 50) a signal S, is detected, which may be magnetic, or from an RFID tag or other proximity sensing system. Signal S causes a mute command 52 to issue as a mute signal MS that can be sent to a muting circuit (not shown) of a control board. Alternatively, the interaction of microphone 12 with the muting function 48 can engage a muting function in microphone 12. When microphone 12 is moving in direction D2 (away from detector 50) then the muting signal will be reversed to unmute microphone 12.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A microphone bed for receiving a microphone, the microphone bed comprising:

a first compressible portion formed to accommodate a first end of the microphone;

a first non-compressible portion into which the compressible portion is coupled, the non-compressible portion having a length that is over half a length of the microphone;

a second non-compressible portion coupled to the first non-compressible portion, which together form a cavity therebetween, the second non-compressible portion having a floor; and a weighted feature extending upward from the floor of the second non-compressible portion.

2. The microphone bed of claim 1, further comprising a second compressible portion coupled to the first non-compressible portion, the second compressible portion positioned to accommodate a mid-portion of the microphone.

3. The microphone bed of claim 2, wherein the second compressible portion is at an end of the first non-compressible portion opposite where the first compressible portion is positioned.

4. The microphone bed of claim 2, wherein the first non-compressible portion has a battery cavity beneath where the microphone lays in the microphone bed.

5. The microphone bed of claim 4, further comprising first and second compressible pads connected to opposite ends of the battery cavity, the compressible pads being configured to secure batteries in the battery cavity.

6. The microphone bed of claim 1, further comprising a third compressible portion coupled to an underside of the second non-compressible portion.

7. The microphone bed of claim 1, wherein the first compressible portion being removably coupled to the first non-compressible portion.

8. The microphone bed of claim 1, wherein the microphone bed is configured to be inserted into one of a plurality of bed receiving cavities in a microphone tray.

9. A microphone bed for receiving a microphone, the microphone bed comprising:

a first compressible portion formed to accommodate a first end of the microphone;

a first non-compressible portion into which the compressible portion is coupled, the non-compressible portion having a length that is over half a length of the microphone;

a second non-compressible portion coupled to the first non-compressible portion, which together form a cavity therebetween, the second non-compressible portion having a floor; and a weight receiving feature extending upward from the floor of the second non-compressible portion.

10. The microphone bed of claim 9, further comprising a second compressible portion coupled to the first non-compressible portion, the second compressible portion positioned to accommodate a mid-portion of the microphone.

11. The microphone bed of claim 10, wherein the second compressible portion is at an end of the first non-compressible portion opposite where the first compressible portion is positioned.

12. The microphone bed of claim 10, wherein the first non-compressible portion has a battery cavity beneath where the microphone lays in the microphone bed.

13. The microphone bed of claim 12, further comprising first and second compressible pads connected to opposite ends of the battery cavity, the compressible pads being configured to secure batteries in the battery cavity.

14. The microphone bed of claim 9, further comprising a third compressible portion coupled to an underside of the second non-compressible portion.

15. The microphone bed of claim 9, wherein the first compressible portion being removably coupled to the first non-compressible portion.

16. The microphone bed of claim 9, wherein the microphone bed is configured to be inserted into one of a plurality of bed receiving cavities in a microphone tray.

17. A microphone bed tray, comprising:

a base having a plurality of cavities, each cavity being arranged to receive a microphone bed, each microphone bed including:

a first compressible portion formed to accommodate a first end of the microphone;

a first non-compressible portion into which the compressible portion is coupled, the non-compressible portion having a length that is over half a length of the microphone;

a second non-compressible portion coupled to the first non-compressible portion, which together form a cavity therebetween, the second non-compressible portion having a floor; and a weighted feature extending upward from the floor of the second non-compressible portion.

18. The microphone bed tray of claim 17, wherein each microphone bed further comprises a second compressible portion coupled to the first non-compressible portion, the second compressible portion positioned to accommodate a mid-portion of the microphone.

19. The microphone bed tray of claim 18, wherein the second compressible portion of each microphone bed is at an end of the first non-compressible portion opposite where the first compressible portion is positioned.

20. The microphone bed tray of claim 18, wherein the first non-compressible portion of each microphone bed has a battery cavity beneath where the microphone lays in the microphone bed.

* * * * *